US008500873B2

(12) United States Patent
Paur et al.

(10) Patent No.: US 8,500,873 B2
(45) Date of Patent: Aug. 6, 2013

(54) PHYSICAL STRUCTURE OF EXHAUST-GAS CLEANING INSTALLATIONS

(75) Inventors: Hanns-Rudolf Paur, Karlsruhe (DE); Andrei Bologa, Stutensee (DE); Klaus Woletz, Eggenstein-Leopoldshafen (DE)

(73) Assignee: Karlsruher Institut fuer Technologie, Karlsruhe (DE)

( * ) Notice: Subject to any disclaimer, the term of this patent is extended or adjusted under 35 U.S.C. 154(b) by 408 days.

(21) Appl. No.: 12/680,601

(22) PCT Filed: Aug. 20, 2008

(86) PCT No.: PCT/EP2008/006817
§ 371 (c)(1),
(2), (4) Date: Jul. 9, 2010

(87) PCT Pub. No.: WO2009/046787
PCT Pub. Date: Apr. 16, 2009

(65) Prior Publication Data

US 2011/0000375 A1 Jan. 6, 2011

(30) Foreign Application Priority Data

Oct. 2, 2007 (DE) ..... 10 2007 047 250

(51) Int. Cl.
*B03C 3/12* (2006.01)
*B03C 3/36* (2006.01)

(52) U.S. Cl.
USPC ..... 96/62; 96/77

(58) Field of Classification Search
USPC ..... 96/60, 62, 63, 75, 77; 95/78, 79
See application file for complete search history.

(56) References Cited

U.S. PATENT DOCUMENTS

| | | | | | |
|---|---|---|---|---|---|
| 2,114,682 | A | * | 4/1938 | Gumaer | 95/79 |
| 3,850,598 | A | * | 11/1974 | Boehm | 96/60 |
| 4,072,477 | A | | 2/1978 | Hanson et al. | |
| 4,248,162 | A | * | 2/1981 | Skeist | 108/50.13 |
| 4,283,205 | A | * | 8/1981 | Schumann | 96/60 |
| 5,591,253 | A | * | 1/1997 | Altman et al. | 96/61 |
| 6,482,253 | B1 | * | 11/2002 | Dunn | 96/62 |
| 6,527,829 | B1 | | 3/2003 | Malkamaeki et al. | |

(Continued)

FOREIGN PATENT DOCUMENTS

| | | | |
|---|---|---|---|
| DE | 2235531 | A1 | 2/1973 |
| DE | 10244051 | C1 | 11/2003 |

(Continued)

*Primary Examiner* — Richard L Chiesa
(74) *Attorney, Agent, or Firm* — Leydig, Voit & Mayer, Ltd.

(57) ABSTRACT

A waste-gas cleaning system for cleaning aerosol-laden gases or atmospheres includes an inlet configured to intake raw gas, an outlet configured to discharge clean gas and at least one assembly including an ionization section and a downstream central collection section disposed centrally with respect to a channel axis. The ionization section includes at least one level at a right angle to the channel axis. The at least one assembly includes at least two substantially identical ionization stages disposed in a plane and arranged uniformly about the channel axis and configured to conduct a gas flow radially, with respect to the channel axis, inward therethrough into the downstream central collection section so as to be similarly diverted such that a flow profile over an inside cross section in the downstream central collection section is not inclined with respect to the channel axis in the course of the gas flow.

23 Claims, 9 Drawing Sheets

U.S. PATENT DOCUMENTS

| | | | | |
|---|---|---|---|---|
| 6,585,809 | B1 * | 7/2003 | Parsa | 96/16 |
| 6,773,489 | B2 * | 8/2004 | Dunn | 95/78 |
| 7,101,424 | B2 | 9/2006 | Waescher et al. | |
| 7,264,658 | B1 * | 9/2007 | Heckel et al. | 96/62 |
| 7,517,394 | B2 | 4/2009 | Bologa et al. | |
| 7,563,312 | B2 | 7/2009 | Waescher et al. | |
| 7,621,986 | B2 | 11/2009 | Bologa et al. | |
| 2004/0040438 | A1 | 3/2004 | Baldrey et al. | |
| 2006/0236858 | A1 | 10/2006 | Chabek et al. | |
| 2009/0071328 | A1 * | 3/2009 | Dunn | 95/62 |

FOREIGN PATENT DOCUMENTS

| | | | | |
|---|---|---|---|---|
| DE | 10259410 | A1 | 7/2004 | |
| DE | 102005023521 | B3 | 6/2006 | |
| DE | 102005045010 | B3 | 11/2006 | |
| DE | 102006055543 | B3 | 1/2008 | |
| EP | 376915 | A2 * | 7/1990 | 96/60 |
| GB | 704054 | A | 2/1954 | |
| GB | 740646 | A | 11/1955 | |
| WO | WO 0169065 | A1 | 9/2001 | |

* cited by examiner

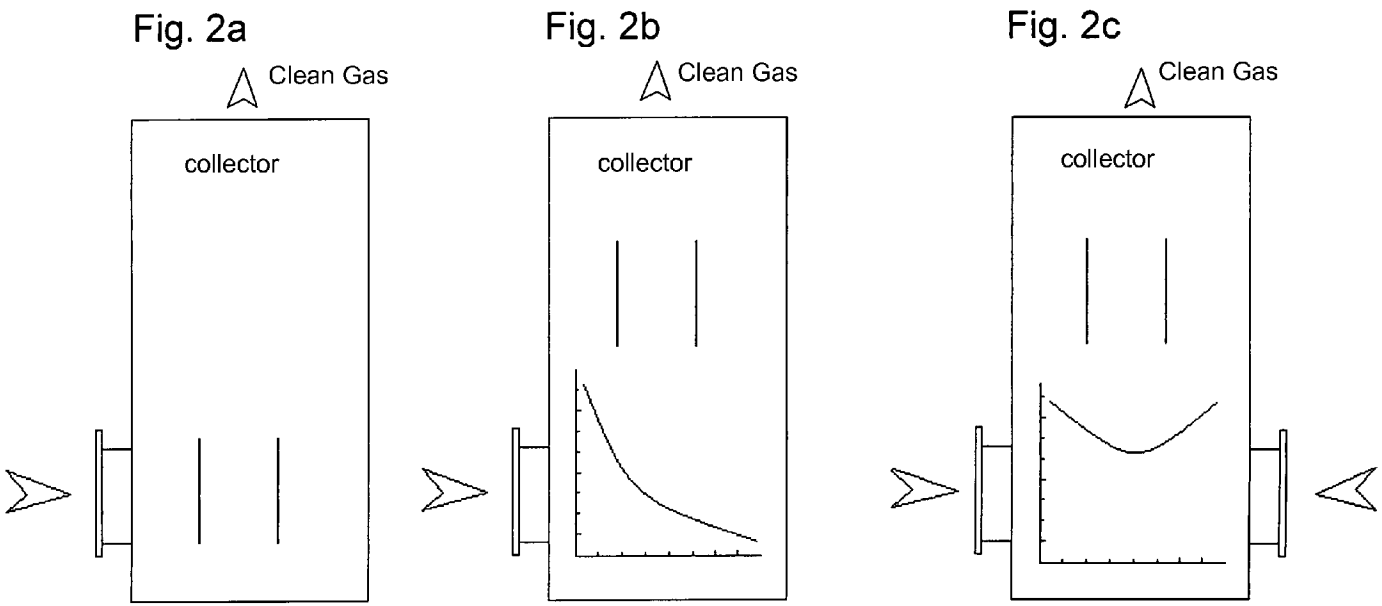
Fig. 2a
Fig. 2b
Fig. 2c
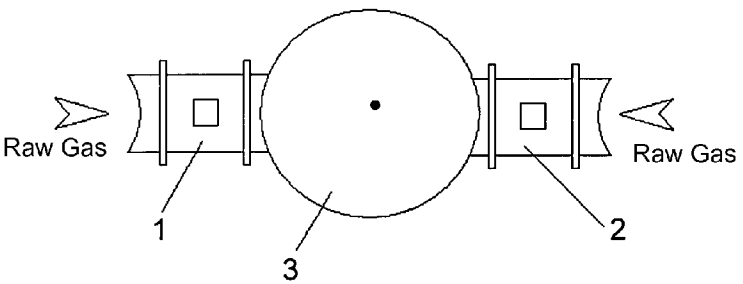
Fig. 3b
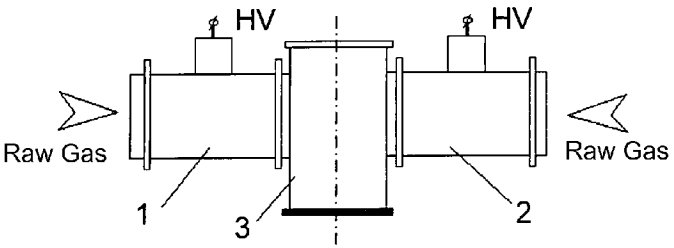
Fig. 3a

PHYSICAL STRUCTURE OF EXHAUST-GAS CLEANING INSTALLATIONS

CROSS REFERENCE TO PRIOR APPLICATIONS

This application is a U.S. National Phase application under 35 U.S.C. §371 of International Application No. PCT/EP2008/006817, filed on Aug. 20, 2008 and which claims benefit to German Patent Application No. 10 2007 047 250.3, filed on Oct. 2, 2007. The International Application was published in German on Apr. 16, 2009 as WO 2009/046787 A2 under PCT Article 21(2).

FIELD

The present invention relates to the structure of waste-gas cleaning systems for cleaning aerosol-laden gases or atmospheres, and to waste-gas cleaning system designs having such a structure. The present invention resides in the technology of electrostatic particle precipitation, for example, in the technology of a space-charge based electrostatic particle precipitator.

BACKGROUND

A waste-gas cleaning system for cleaning aerosol-laden gases or atmospheres includes at least one assembly including an ionization section and a collection section provided downstream thereof. The waste-gas cleaning system is connected by its inlet to a raw gas channel or raw gas channels. At its outlet, the waste-gas cleaning system discharges clean gas into the environment or into a waste-gas channel leading further on.

In a space-charge precipitator, unipolar charged particles are precipitated according to the field of their own space charge.

Depending on the structural design of the precipitator, the self-precipitation can occur in a wet scrubber within the tubular electrodes in a filter. Wet scrubbers have provided a useful increase in efficiency by charging the particles/aerosols prior to their entry into the scrubber. Charged particles are precipitated by wet scrubbing and electrostatic precipitation under the influence of the space charge.

An electrostatic precipitator also operates on the principle of mutual repulsion of charged particles at a wall at a reference potential, for example, at ground potential. As the charged particles pass through the grounded section of a precipitator, a fraction of the charged particles are forced to the grounded wall by the electric field created by the space charge. Precipitated particles are entrained in the coalesced water which runs down the walls of the grounded electrode tubes and is drained off.

DE 22 35 531 describes an ionizing wet scrubber in which a gas stream to be processed is ionized before it passes through the wet scrubber so as to provide the particles/aerosols in the gas stream with an electric charge of predetermined polarity. As the gas stream is flowing, the charged particles/aerosols are brought into proximity with the scrubber liquid and/or the packing elements by the attractive forces acting between the charged particles and the electrically neutral packing elements and the liquid. The particles are removed from the gas stream by the scrubber liquid.

US 2006/0236858 A1 describes an ionizing particulate scrubber composed of a charging section and a collection section. The collector includes either a fixed or fluid bed packed section which is constantly irrigated from above. The gas stream and charged particulate are immediately sent from the charge section to the collection section of the system, and clean gas is then passed through an entrainment separator section to remove liquid droplets.

The described separators have a collection chamber disposed between the charging section and the collection section. Therefore, the space charge distribution at the collector inlet is homogeneous. The direction of the gas stream is the same at the inlet and outlet of the collector.

U.S. Pat. No. 4,072,477 or DE 10 2006 055 543 describe electrostatic space-charge precipitators which do not have a collection chamber between the charging section and the collection section. The outlet of the charging section is connected to a chamber containing electrically conductive packing material such as, for example, tower packing elements. The direction of the gas stream is either the same at the inlet and outlet, or the gas stream changes its direction in the collection section. In the latter case, the space charge distribution in the inlet zone of the collector is not homogeneous. It has a maximum in the region where the gas stream enters the collector and has a minimum at the wall opposite the inlet zone. The resulting space charge distribution is not homogeneous. When particles are precipitated, the space charge field decreases, and the aerosol collection efficiency deteriorates in the central region and the region opposite the flow entry. Because of that, the inlet zone of the collector is frequently ineffective for particle collection.

Prior art space-charge precipitators (U.S. Pat. No. 4,072,477, FIG. 1, and DE 10 2006 055 543, FIGS. 13 and 14) are illustrated in FIG. 1 herein for purposes of comparison. In these precipitators, the outlet of the charging/ionization section is coupled to a grounded collection section composed of electrically conductive packing material, such as tower packing elements. The gas stream changes direction in the inlet zone of the collection section.

DE 10 2006 055 543, DE 10 2005 4045 010, DE 10 2005 023 521 and DE 102 44 051 describe circularly curved, grounded nozzle plates.

Describes a charging/ionization section in DE 10 2006 055 543.

DE 102 59 410, describes a collector, and a spray system for washing purposes

SUMMARY

An aspect of the present invention is to provide increased efficiency of the precipitation of electrically charged particles in the inlet zone of a collector of an electrostatic waste-gas cleaning system.

In an embodiment, the present invention provides a waste-gas cleaning system for cleaning aerosol-laden gases or atmospheres. The system includes an inlet configured to intake raw gas; an outlet configured to discharge clean gas; and at least one assembly including an ionization section and a downstream central collection section disposed centrally with respect to a channel axis. The ionization section includes at least one level at a right angle to the channel axis. The at least one assembly includes at least two substantially identical ionization stages disposed in a plane and arranged uniformly about the channel axis and configured to conduct a gas flow radially, with respect to the channel axis, inward therethrough into the downstream central collection section so as to be similarly diverted such that a flow profile over an inside cross section in the downstream central collection section is not inclined with respect to the channel axis in the course of the gas flow.

BRIEF DESCRIPTION OF THE DRAWINGS

The present invention is described in greater detail below on the basis of embodiments and of the drawings in which:

FIG. 2*a* is a view of a collection section having three regions in the inlet zone;

FIG. 2*b* is a view illustrating the space charge density profile in the case of inflow from one side;

FIG. 2*c* is a view illustrating the space charge density profile in the case of inflow from both sides;

FIG. 3*a* is a side view of a precipitator having two ionization stages disposed opposite one another;

FIG. 3*b* is a top view of the precipitator having two ionization stages disposed opposite one another;

DETAILED DESCRIPTION

Figure 1A:
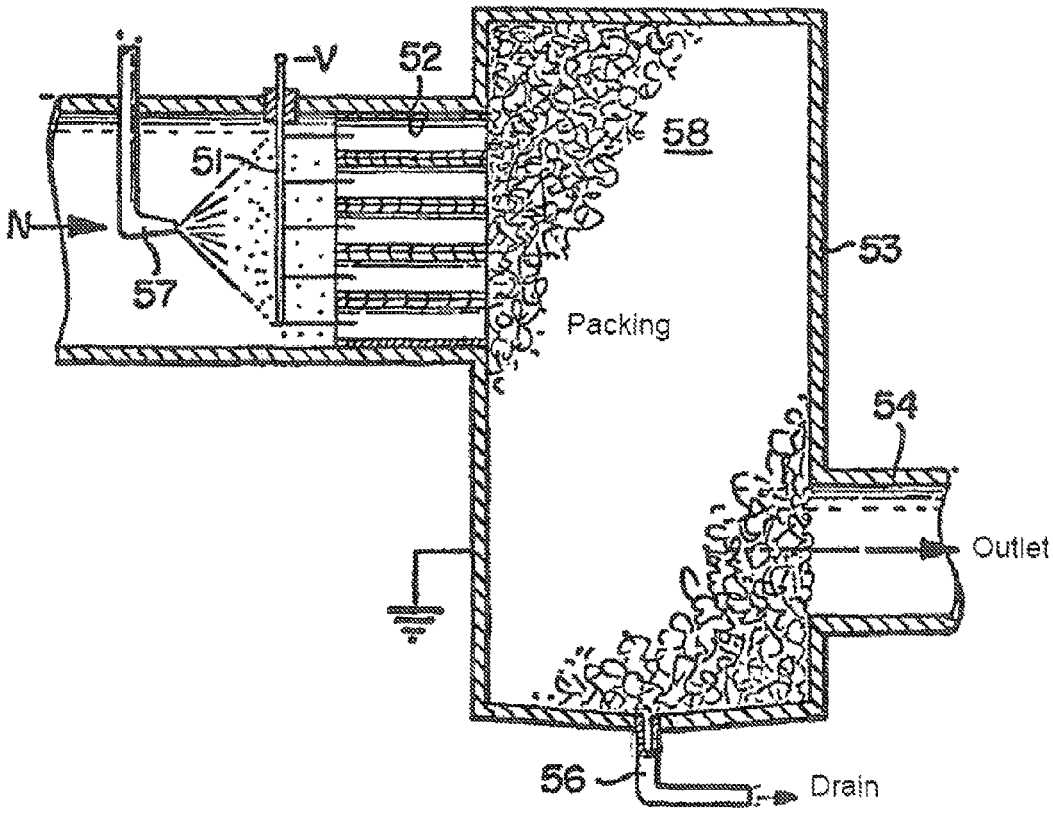
Fig. 1a Prior Art
FIG. 1*a* is a view of a prior art precipitator without a collection chamber.
Figure 1B:
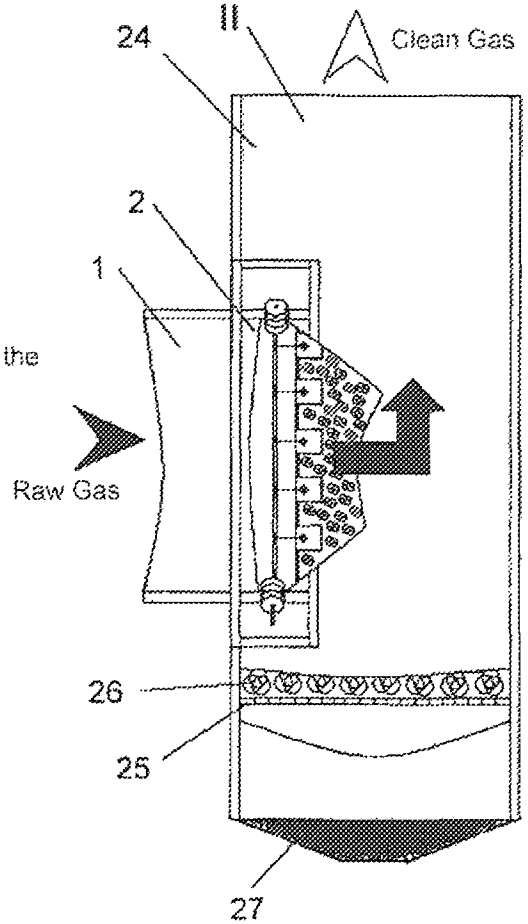
Fig. 1b Prior Art
FIG. 1*b* is a view of a prior art precipitator without a collection chamber.
Figure 1B:
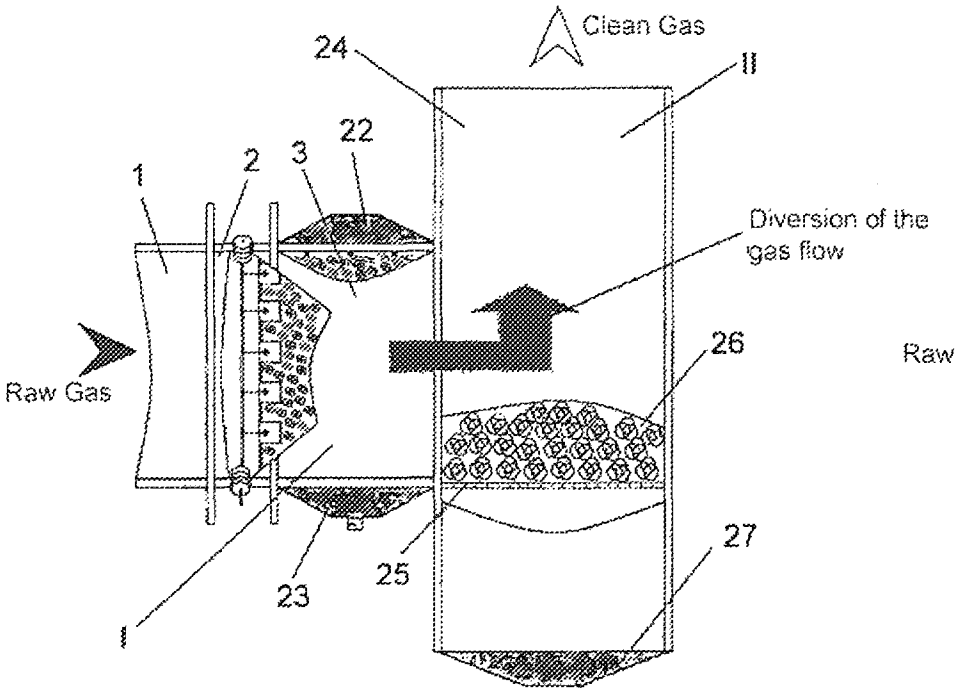
Fig. 1b Prior Art

The ionization section of an assembly includes at least one level, which is at right angles to the channel axis and has at least two substantially identical ionization stages which lie in one plane and are distributed uniformly around the channel axis, and through which the gas flows radially with respect to the channel axis. When the gas flows radially inward through the ionization stages, the gas streams flowing into the associated collection section, which is disposed centrally with respect to the channel axis, change their direction of flow. After entering the collector, they are diverted into the same direction in such a way that the resulting flow profile over the inside cross section in the collector area will not be inclined or biased toward one side with respect to the channel axis in the course of the gas flow.

When the gas flows radially outward through the ionization stages, the collection section can include collector stages which are each connected downstream of an ionization stage of the ionization section, and in which the radial gas stream from the associated ionization stage enters and in which it is diverted to a direction parallel to the channel axis in the course of the gas flow.

Based on this, a waste-gas cleaning system can be specified as follows: the waste-gas cleaning system includes at least two assemblies which are arranged in series along the channel axis and which each include an ionization section and a central collection section, the central collection sections following one another in direct succession and being an initial portion of the channel that carries the gas further on. The first central collection section in the direction of the gas flow allows the gas streams entering it to pass on only to and through the next central collection section. Finally, an additive gas stream composed of flows emerges from the last central collection section in the direction of the gas flow. The assemblies are arranged one after the other in the same way or angularly offset from each other with respect to the channel axis.

The waste-gas cleaning system is structurally based as set forth above and is specified as follows: Here, the waste-gas cleaning system includes at least two assemblies which are arranged in series along the channel axis and which each include an ionization section and a collection section. In this embodiment, each assembly has the same number of ionization stages, and the gas flow in the ionization stages of successive assemblies is in radially opposite directions. The channel supplying the raw gas has an end section which is closed at the end and via which said raw gas channel either fans out the raw gas stream through openings in its shell toward the connected ionization section of the first flow-receiving assembly into substreams which each flow to one ionization stage respectively, in which the respective substream flows radially outward to the respective collection stage connected thereto. A channel section leads from said collection stage to the associated ionization stage of the next assembly, in which the gas substream flows radially inward. All substreams passing through this assembly flow into the associated central collection section, where they change direction and flow together in an axial direction to be discharged or passed on for further processing.

The end of the channel supplying the raw gas can merge fanwise into channels which each open into one ionization stage of the next assembly respectively, so as to flow radially inward to the central collection section therein. From there, the gas stream composed of the gas substreams flows into the axially downstream channel section, which is closed at its end, and in this channel section, said gas stream fans out through openings in the shell into the connected ionization stages of the next assembly. They then flow radially outward therein to their respective collector stages, from where they are passed on to be discharged, either individually or together, or to be further processed in a subsequent assembly.

In an embodiment of the present invention, the waste-gas cleaning system includes a first hollow-cylindrical member which is similar to the cross section of the gas channel and serves as an ionization section, and whose wall intersects at least one plane perpendicular to the channel axis. In this plane, the ionization stages extending through the hollow cylinder wall are uniformly distributed around the circumference. A second hollow-cylindrical member that is similar to the cross section of the gas channel surrounds said ionization stages in the manner of a shell at least over the length of the first hollow-cylindrical member. In this embodiment, the raw gas channel either opens into the end of the first hollow-cylindrical member, which is closed at the opposite end, and specifically in such a way that the raw gas must flow radially outward through the ionization stages, and the surrounding second hollow-cylindrical member is connected at the raw-gas end with the first hollow-cylindrical member by an annular disk in a gas-tight manner. This forms the collector for the gas flowing in from the ionization stages, the gas stream being recombined in said collector and discharged therefrom as a clean gas stream at the open end remote from the raw gas side.

The raw gas channel can be flange-mounted to the end of the second hollow cylinder. The second hollow cylinder is connected with the first hollow cylinder by a gas-tight annular disk at the end facing away from the raw gas stream, the first hollow-cylindrical member being closed at the end facing the raw gas stream.

The raw gas channel can be flange-mounted to the shell of the second hollow cylinder and, together with the first hollow cylinder, form an annular hollow space which is closed at its end in a gas-tight manner. Thus, when the raw gas enters at the end and through the shell, the entire raw gas stream flows radially inward through the ionization stages into the interior of the first hollow cylinder. There, the substreams change direction and continue as a combined stream flowing from the first hollow cylinder and further on through the collection section. Now, the inside cross section of the first hollow cylinder is closed in a gas-tight manner at the end facing away from where the flow continues. The gas channel can be convex round or convex polygonal in cross section as seen from outside.

The situation can be improved by changing the manner in which a gas stream flows into the inlet zone of a collection section. The improvement applies to electrostatic precipitators which do not have a collection chamber between the charging/ionization section and the collection section, and in which the gas flows into the inlet of the collection section only through an opening in a side wall of the collection section, in which the gas stream changes its direction in the collection section.

In order to improve the space charge distribution in the inlet zone of the collection section, it is therefore proposed that the charged particle-laden gas stream flow in through at least two openings in the side wall of the collector, said openings being located opposite one another in one plane. The distribution of the space charge can thus be improved by introducing the charged particle-laden gas stream uniformly and evenly through a plurality of openings in the side wall of the collector housing, said plurality of openings being located in one pane or a plurality of successive planes.

This can eliminate drawbacks of conventional waste-gas cleaning systems. What is responsible is that the charging/ionization stage and the collector are arranged in direct succession, and that the space charge distribution over the inside cross section of the inlet zone of the collector is, as it were, symmetrical with respect to the collector axis. This physical structure of the waste-gas cleaning system also provides a construction which is technically simple and easy to implement.

In FIG. 2*a*, the gas stream enters the inlet zone of the collection section only from the single opening shown to the left of the figure. The gas stream is rough and is divided by two parallel vertical lines into the regions "inlet", "central" and "opposite", which follow one another in succession across the inside diameter in the inlet zone. There, the space charge density decreases along the axial projection of the axis of the opening toward the opposite wall of the collection section. FIG. 2*b* shows qualitatively the profile of the decrease in space charge; i.e., the space charge density profile, for the case that inflow from the ionization stage is from one side only: the space charge density is initially maximum in the inlet zone, decreases rapidly toward the center, and becomes minimum at the opposite wall. The space charge density profile decreases monotonously, or slopes, from the inlet opening toward the opposite wall; i.e., across the inside diameter. In such a physical configuration, the inlet zone of the collection section is used inefficiently for particle precipitation/collection.

When the charged particle-laden gas stream flows through the collector wall into the inlet zone from opposite directions through at least two openings located opposite one another, the space charge distribution is decisively improved there, because two space charge density profiles are superimposed upon each other in opposite directions. In FIG. 2*c*, the result is qualitatively illustrated across the inside diameter of the inlet zone of the collection section. There is no region of low space charge density at the opposite wall anymore. If at all there is a central dip in the space charge distribution or space charge density profile. To this end, a minimum of two inlet openings are required.

The gas laden with charged particles/aerosols is introduced into the collector through openings located opposite one another. Therefore, a larger amount of charged particles reaches the central inlet zone, where they increase the space charge density. Because of this, the precipitation efficiency is increased, and the inlet zone is used more intensively for particle collection. When gas streams from opposite directions/openings mix in the central region, the turbulence in the space charge distribution is increased, thereby increasing the collector efficiency.

The precipitator, in which the gas stream laden with charged particles/aerosols enters the inlet zone of collector 4 through at least two openings located opposite one another in the side walls, is schematically shown in the side view of FIG. 3*a*) and the top view of FIG. 3*b*). The charging/ionization section forming part of the precipitator includes these, for example, two channels/ionization stages 1 and 2. The direction of gas flow is indicated by arrows.

The charging/ionization section may include two or more than two channels/ionization stages. An even number of ionization stages can, for example, be used, because in that case, given a uniform distribution around the axis of the precipitator, there are always two openings of ionization stages axially opposite each other in the inlet zone of the collection section, and the space charge densities in the two gas streams directed toward each other are superimposed upon each other as desired in a hump-shaped manner over the inside cross section of the inlet zone of the collector, provided the inflows are of the same magnitude. If there are 3 or a greater odd number of flows of the same magnitude entering the inlet zone of the collector, an asymmetrical space charge density distribution develops over the inside cross section. This asymmetrical space charge density distribution becomes increasingly less pronounced; i.e., becomes more symmetrical, with increasing number of inflows. If the flows entering the inlet zone are of different magnitude, the space charge profile over the inside cross section becomes asymmetrical with respect to the precipitator axis, said asymmetrization being dependent on the magnitudes of inflow.

Figure 4:
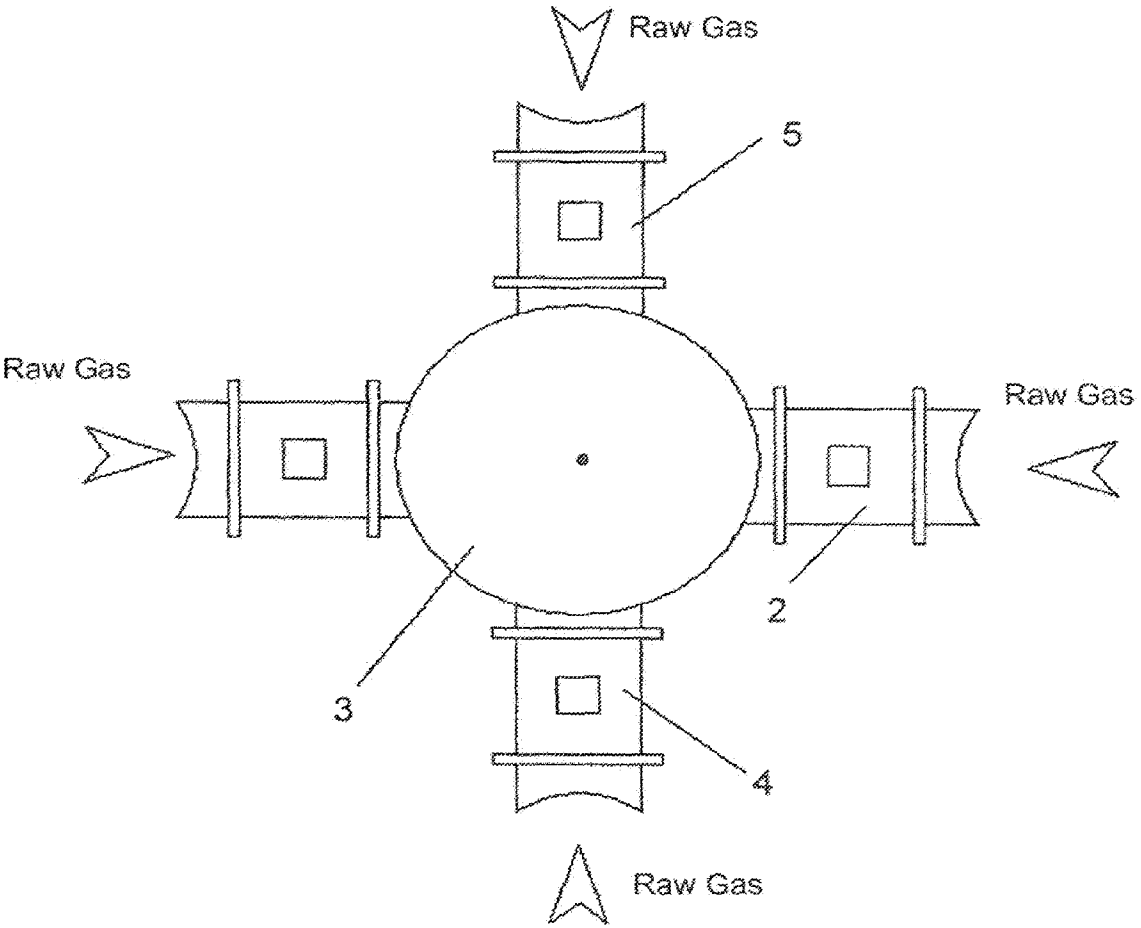
FIG. 4 is a top view of a precipitator having four ionization stages disposed opposite one another in pairs.

FIG. 4 illustrates the design of a precipitator in which the four ionization stages 1, 2, 4, 5 of the ionization section are disposed in a plane perpendicular to the axis of the precipitator and are distributed uniformly around said axis, and in which each two such ionization stages 1, 2 and 4, 5, respectively, are disposed such that their openings into central collection section 3 are opposite one another; i.e., the respective two gas flows from ionization stages 1, 2 and 4, 5 are directed toward each other, or the axes of said inlet openings coincide in pairs. The respective gas stream through ionization stages 1, 2, 4, 5 flows radially toward the axis of the precipitator, as indicated by the arrows.

If the ionization section includes at least four ionization stages, these stages may be distributed over at least two levels following one another in succession along the axis of the precipitator. If the levels are identical in construction, said stages may be coincident or angularly offset from one another by an angle $\alpha$, as seen along the axis of the precipitator. Otherwise, it is necessary to distribute the ionization stages uniformly around the precipitator axis, so that the required space charge density distribution in the inlet zone of the central collection section can be achieved more easily. FIGS.

Figure 5A:
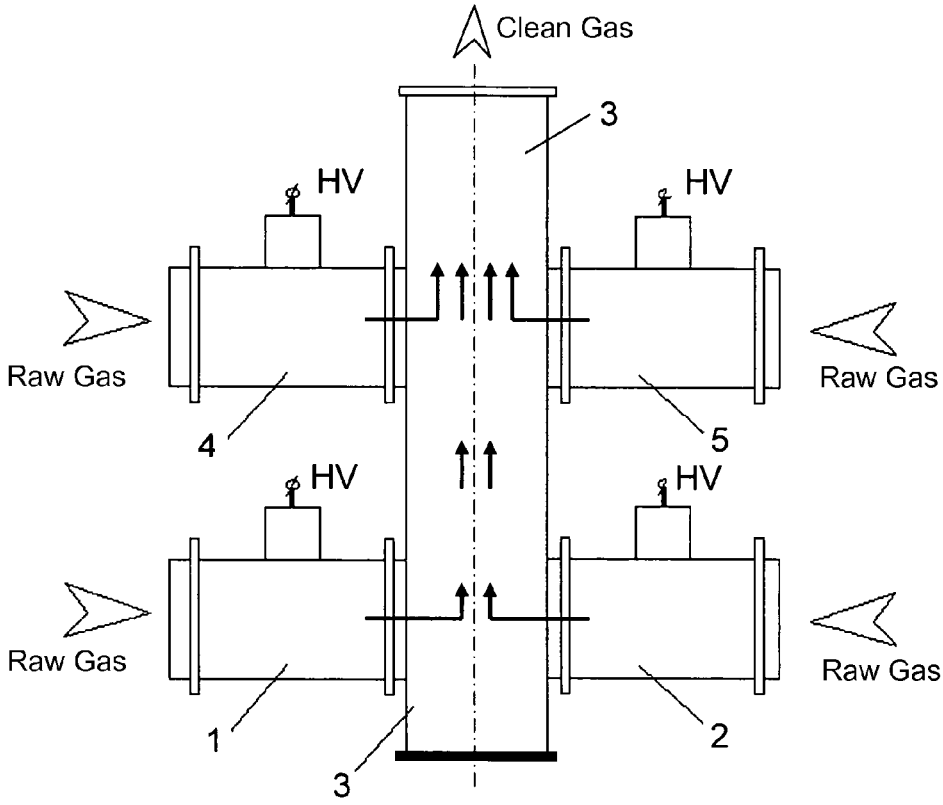
FIG. 5*a* is a side view of a precipitator including two precipitator levels.
Figure 5B:
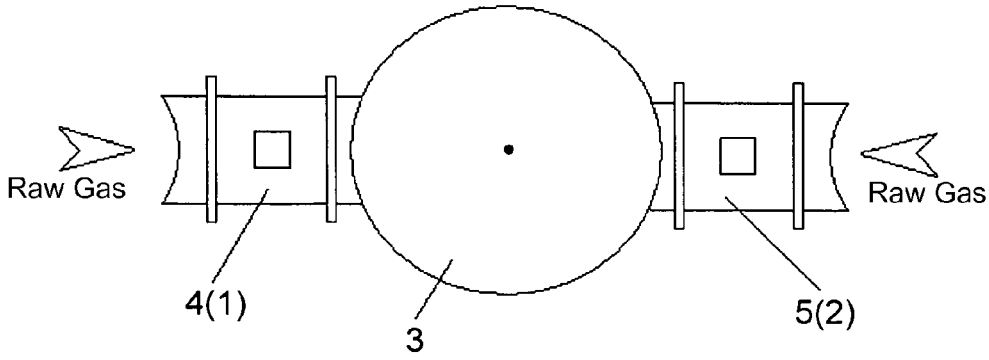
FIG. 5*b* is a top view of a precipitator including two precipitator levels.
Figure 6:
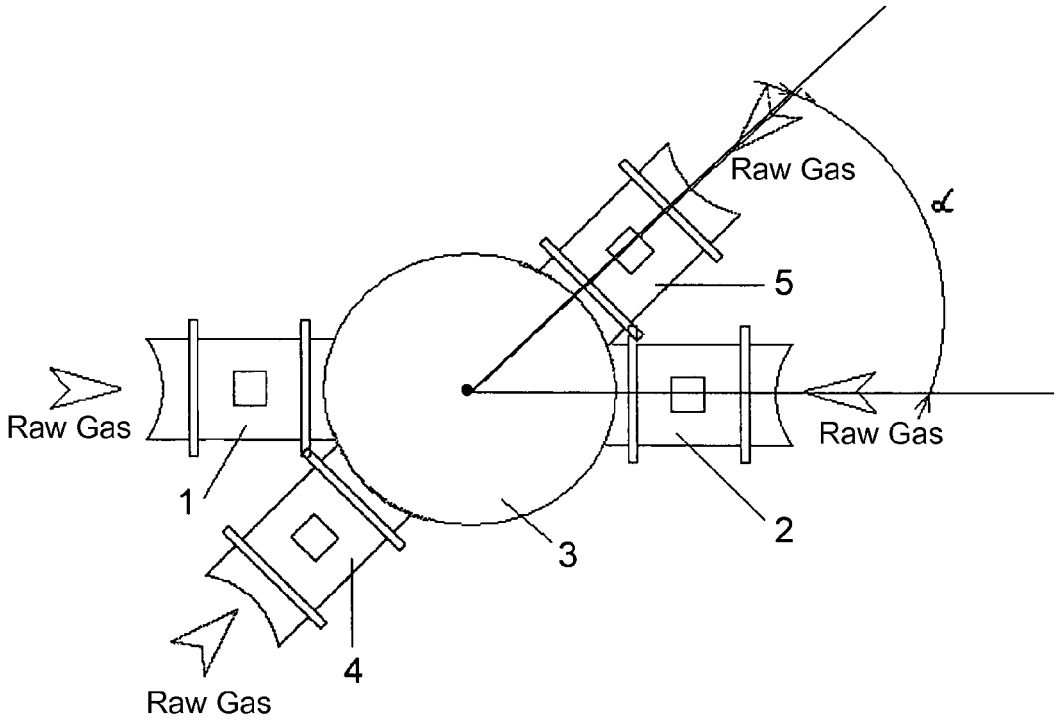
FIG. 6 is a top view of a precipitator including two precipitator levels which are angularly offset from each other.

5*a* and 5*b* show a precipitator design including two coincident levels on which the respective flows through ionization stages 1, 2 and 4, 5 are directed radially inward toward the precipitator axis. The two central collection sections follow one another in direct succession and are constructed together, so as to form the overall central collection section 3. On each level, the respective two inflows from the respective ionization stages are directed toward one another and are diverted upward and passed as a single gas stream from this level further on in the collection section so as to combine with the gas stream of the next level to form the overall gas stream emerging from the precipitator. FIG. 5*a* is a side view illustrating the precipitator design and showing the respective how-voltage connection HV at each of the ionization stages. FIG. 5*b* is a top or plan view along the axis of the precipitator. FIG. 6, by way of example, shows two identically constructed levels of the ionization section which are angularly offset from each other by an angle α, here indicated as an acute angle, with respect to the precipitator axis. It is possible for successive levels of the ionization section to have an angular offset of $0<=\alpha<=90°$.

Figure 7A:
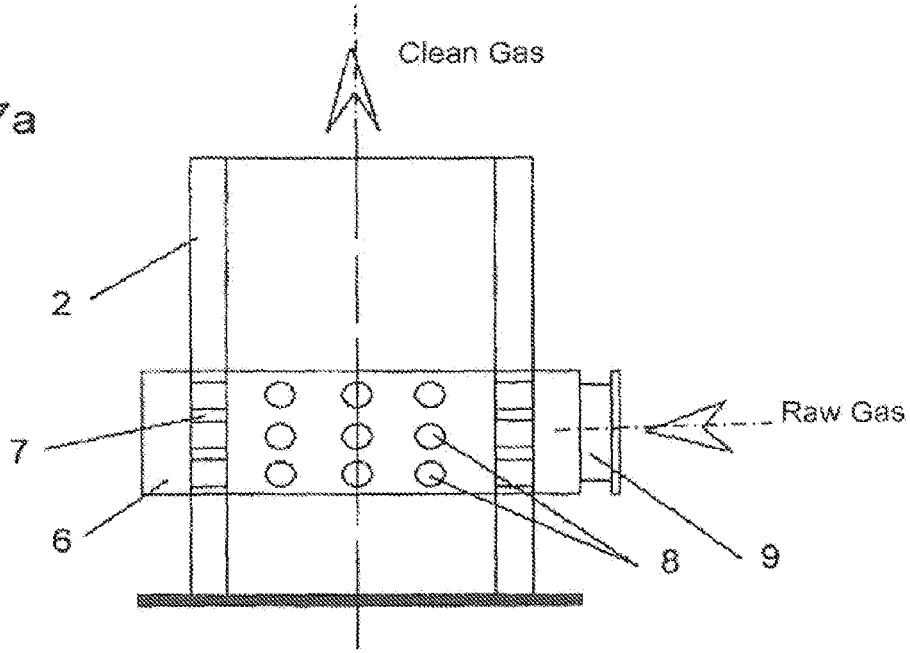
FIG. 7*a* is a side view of a circular-cylindrical collection section with a portion of the wall being used as an ionization section.
Figure 7B:
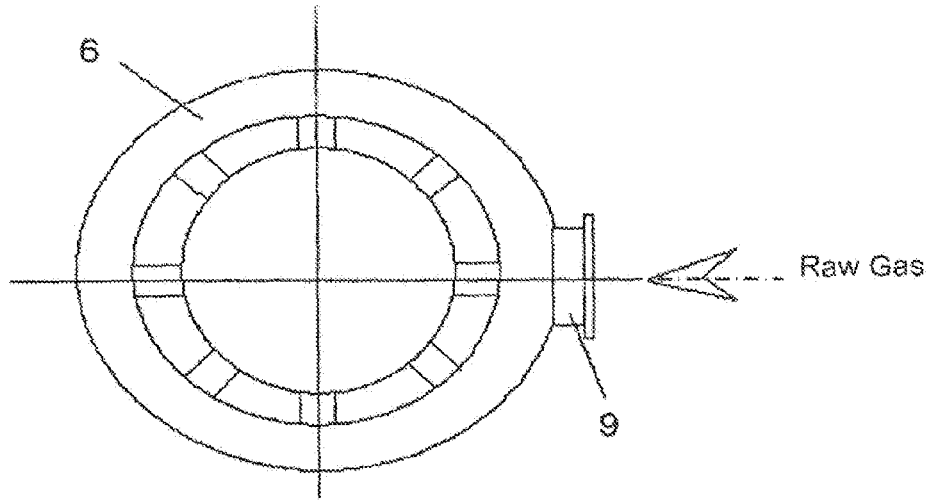
FIG. 7*b* is a top view of a circular-cylindrical collection section with a portion of the wall being used as an ionization section.

A space-charge precipitator design, in which the ionization section and its inlet openings to the collection section form an integral part of the same, is shown in FIGS. 7*a* and 7*b* in a convex round configuration, here specifically a circular-cylindrical configuration. The gas stream enters charging/ionization section 7 through a flange 9 provided at the shell for the raw gas channel, flows into annular channel 6, and radially inward through ionization nozzles 8. Ionization nozzles 8 are disposed in a plurality of parallel planes following one another in succession in the circular wall of the hollow cylinder; i.e. ionization section 7 is here designed in this manner. The plane-wise radial inflow therefrom into the central collection section produces the space charge density distribution over the inside cross section of the inlet zone in each plane, and is rotationally symmetric with respect to the precipitator axis, at least when the flows entering from ionization nozzles 8 are of the same flow magnitude in each plane, respectively. Accordingly, there are no space charge distribution regions free of electric charges and, therefore, the grounded inner wall of the collection section attracts the charged particles/aerosols from the passing gas stream uniformly around the circumference. The particles/aerosols impinging on the grounded wall are electrically neutralized, entrained by the water running down the wall, and discharged from the precipitator.

Figure 8:
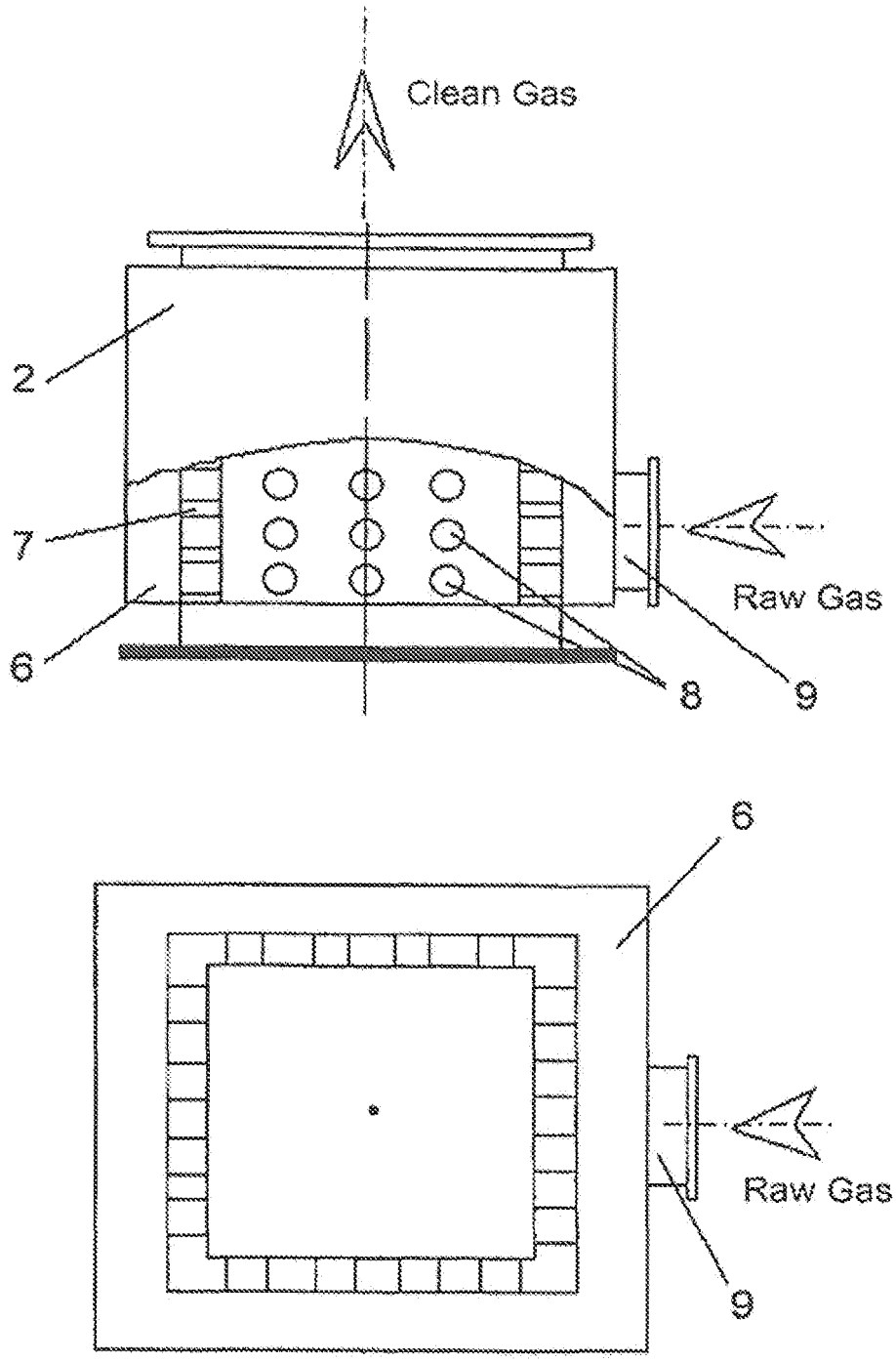
FIG. 8 is a side and top view of a prismatic collection section with a portion of the wall being used as an ionization section.

The hollow-cylindrical wall portion containing ionization nozzles 8 directed into the inlet zone of the collection section and having a circular inside cross section may be manufactured in the form of a circularly curved, grounded nozzle plate, as described in which is directly connected to the central collection section at its downstream end, here at the top in FIG. 7*a*. FIGS. 8*a* and 8*b* show a precipitator design which is convex polygonal, in particular rectangular, in shape, and is similar to the convex round, in particular circular, precipitator of FIGS. 7*a* and 7*b*. Its ionization section includes four flat nozzles plates, which are similar to those described in DE 10 2006 055 543 and form a rectangular inside cross section. The inflow and outflow of the raw gas is as shown in FIG. 7*a*. Here, too, a plurality of levels of lionization stages are arranged in series along the axis of the precipitator.

In order to achieve forced gas flow, the precipitator is closed at one end by a plate, such as in the design according to FIGS. 7*a* and 8*a*, as is indicated by the bold line at the bottom in the respective figures.

Figure 9:
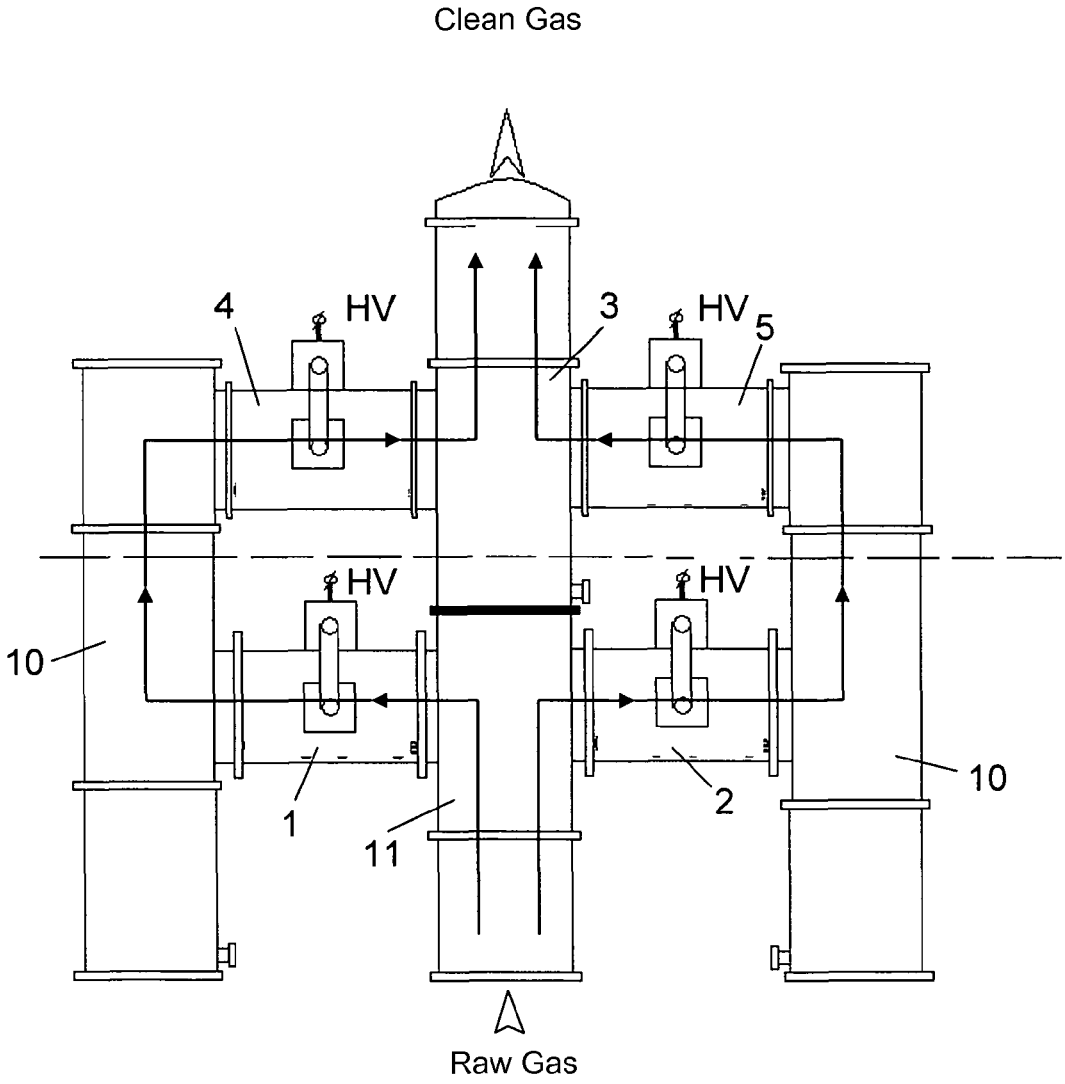
FIG. 9 is a side view of a precipitator including two precipitator levels, on each of which the gas flows in radially opposite directions in the ionization sections.

FIG. 9 shows an example of another embodiment. In this figure, the raw gas supplied (arrow) enters the precipitator vertically centrally. The channel supplying the raw gas (not shown) is flange-mounted by its end to channel section 11, which is closed at its downstream end. In said channel section, the raw gas flow changes direction and is, for example, uniformly, distributed to the left and right in the figure into the respective charging/ionization stages 1 and 2. The two gas substreams flow through their ionization stages 1, 2 radially outward with respect to the precipitator axis. In these ionization stages, the particles/aerosols are ionized by high voltage HV. The gas streams from the two ionization stages 1 and 2 enter their respective collectors 10, which are mounted directly to the respective ionization stages on the outside. In these outer collectors 10, the gas streams are diverted upward in the figure. In a downward extension, there is provided a flange-mounted tubular member, which is closed at its lowest point and is there provided with a drain device shown as the small flange. The two outer collectors 10 each have flange-mounted thereto a tubular member which is closed at its downstream end and is flange-mounted at its shell to the associated ionization stage. Thus, the gas substream, which initially flows vertically upward, is diverted into the next ionization stage 4 or 5, respectively, in which it flows radially inward toward the precipitator axis. In these two next ionization stages 4 and 5, the electrically neutral particles/aerosols remaining in the respective gas substreams are ionized by high voltage HV. The gas substreams emerge from the openings of their respective ionization stages 4, 5 and enter the inlet zone of central collection section 3, which is connected by flange joints at its shell. In this inlet zone, the two gas substreams meet again, and are diverted in the same direction to flow as a recombined gas stream upward in the figure and to finally emerge from central collection section 3 as a clean gas stream. In the inlet zone of central collection section 3, the non-inclined, possibly double-hump-shaped, space charge distribution is obtained again, which can, for example, be symmetrical with respect to the precipitator axis, and enables the particles/aerosols to be efficiently deposited on the collector.

The high efficiency of particle precipitation in a precipitator having such a structure will now be summarized with reference to the process occurring inside the electrostatic space-charge precipitator:

The particle/aerosol-laden gas stream passes through the charging/ionization section. The particles in the gas stream are electrically charged in the field of a corona discharge. In the electrostatic "single-field" precipitator, the aerosol-laden gas stream passes through ionization stages 1 and 2 or 1, 2, 4, 5, depending on the precipitator design, and enters the inlet zone of collection section 3. Since the space charge density distribution developing over the inside cross section upon entry into the collection section is no longer biased toward one side and does no longer decrease toward the opposite wall, a much more efficient collection of electrically charged particles is obtained in the collector. This advantageous space charge distribution over the inside cross section can, for example, be symmetrical with respect to the precipitator axis; i.e., does no longer decrease toward one side, results in the much more efficient precipitation, which is only obtained by two gas substreams flowing toward each other and being diverted in the same direction.

The advantage of the precipitator of the present invention lies in the process-assisting use of the inlet zone of the collection section. Because of this, the size of the collection section can be significantly reduced, and the collector housing can be built smaller. This provides a compact design for the precipitator, as can be seen particularly well in the exemplary embodiments shown in FIGS. 7*a* through 8*b*. This is associated with a reduction in the manufacturing cost of the space-charge precipitator, and thus, a reduction in investment costs.

The present invention is not limited to embodiments described herein; reference should be had to the appended claims.

LIST OF REFERENCE NUMERALS (FOR FIGS. 2*a* THROUGH 9 ONLY)

1 ionization stage
2 ionization stage
3 collection section
4 ionization stage
5 ionization stage
6 annular channel
7 ionization stage(s)
8 nozzle
9 flange
10 collector, outer collector
11 channel section

What is claimed is:

1. A waste-gas cleaning system for cleaning aerosol-laden gases or atmospheres, the system comprising:

an inlet configured to intake raw gas;

an outlet configured to discharge clean gas; and at least one assembly including an ionization section and a downstream central collection section disposed centrally with respect to a channel axis, the ionization section including at least one level at a right angle to the channel axis, the at least one assembly including at least two substantially identical ionization stages disposed in a plane and arranged uniformly about the channel axis and configured to conduct a gas flow radially, with respect to the channel axis, inward therethrough into the downstream central collection section so as to be similarly diverted such that a flow profile over an inside cross section in the downstream central collection section is not inclined with respect to the channel axis in the course of the gas flow.

2. The waste-gas cleaning system as recited in claim 1, further comprising an outlet channel connected with the outlet, wherein the clean gas is discharged into the outlet channel.

3. The waste-gas cleaning system as recited in claim 1, wherein at least two assemblies are arranged in series along the channel axis, the downstream central collection sections being arranged in direct succession and constituting an initial portion of a channel that conveys the gas; and a first downstream central collection section in the direction of gas flow allows the gas streams entering it to only pass on to and through a next downstream central collection section, so that an additive gas stream emerges from a last collection section in the direction of gas flow.

4. The waste-gas cleaning system as recited in claim 3, wherein the at least two assemblies are arranged one after the other in the same configuration with respect to the channel axis.

5. The waste-gas cleaning system as recited in claim 3, wherein the at least two assemblies are arranged angularly offset from each other with respect to the channel axis.

6. The waste-gas cleaning system as recited in claim 1, wherein at least two assemblies are arranged in series along the channel axis, the at least two assemblies each including an ionization section and a downstream collection section, each assembly having the same number of ionization stages, the gas flow in the ionization stages of successive assemblies being in radially opposite directions, and wherein the inlet includes a raw gas channel having a shell with a closed end section having openings so that the raw gas fans out through the openings in the shell of the raw gas channel toward the connected ionization section of a first flow-receiving assembly so as to form substreams which flow to a respective ionization stage, whereby the respective substreams flow radially outward to respective downstream collection stages connected thereto, from which respective downstream collection stages a channel section leads to an associated ionization stage of a next assembly in which the gas substream flows radially inward, whereby all substreams passing through the next assembly flow into an associated downstream central collection section so that the substreams change direction and flow together in an axial direction to be discharged or passed on for further processing.

7. The waste-gas cleaning system as recited in claim 1, wherein at least two assemblies are arranged in series along the channel axis, the at least two assemblies each including an ionization section and a downstream collection section, each assembly having the same number of ionization stages, the gas flow in the ionization stages of successive assemblies being in radially opposite directions, and the inlet includes a raw gas channel having an end that merges fanwise into channels, the channels each opening into one ionization stage of the next respective assembly so that a gas stream made of respective gas substreams in the channels flow radially inward to the downstream central collection section, so that the gas substreams flow into an axially downstream channel section having a shell with a closed end section having openings, so that the gas stream again fans out through the openings in the shell into connected ionization stages of a next assembly so as to flow in said ionization stages radially outward to respective downstream collection stages to be discharged individually, together or to be further processed.

8. The waste-gas cleaning system as recited in claim 1, further comprising a first hollow-cylindrical ionization member having a wall which intersects at least one plane perpendicular to the channel axis, in which at least one perpendicular plane ionization stages which extend through the hollow cylinder wall are uniformly distributed around a circumference, and a second hollow-cylindrical member surrounding the ionization stages at least over a length of the first hollow-cylindrical ionization member, wherein the inlet includes a raw gas channel opening into an end of the first hollow-cylindrical ionization member which is closed at the opposite end so that the raw gas flow radially outward through the ionization stages, and the surrounding second hollow-cylindrical member is connected at a raw-gas end with the first hollow-cylindrical ionization member by an annular disk in a gas-tight manner to form a downstream collector for the gas flowing in from the ionization stages, the gas stream being recombined in the downstream collector and discharged therefrom as a clean gas stream at the open end remote from the raw gas side.

9. The waste-gas cleaning system as recited in claim 7, wherein the gas channel is convex round or convex polygonal in cross section as seen from outside.

10. The waste-gas cleaning system as recited in claim 1, further comprising a first hollow-cylindrical ionization member having a wall which intersects at least one plane perpendicular to the channel axis and a second hollow-cylindrical member surrounding the ionization stages at least over a length of the first hollow-cylindrical member, wherein a raw gas channel is flange-mounted to the end of the second hollow cylindrical member, the second hollow cylindrical member being connected with the first hollow cylindrical ionization member by a gas-tight annular disk at the end remote from the raw gas stream, the first hollow-cylindrical ionization member being closed at the end facing the raw gas stream.

11. The waste-gas cleaning system as recited in claim 1, further comprising a first hollow-cylindrical ionization member configured to ionize, whose wall intersects at least one plane perpendicular to the channel axis and a second hollow-cylindrical member surrounding the ionization stages at least over a length of the first hollow-cylindrical member, wherein a raw gas channel is flange-mounted to a shell of the second hollow cylindrical member and, together with the first hollow cylindrical ionization member, forms an annular hollow space which is closed at an end in a gas-tight manner, so that, when the raw gas enters at an end and through the shell, the entire raw gas stream flows radially inward through the ionization stages into the interior of the first hollow cylindrical ionization member, where the gas changes direction and flows from the first hollow cylindrical ionization member and through the downstream central collection section, the inside cross section of the first hollow cylindrical member being closed in a gas-tight manner at an end remote from where the gas flows.

12. A waste-gas cleaning system for cleaning aerosol-laden gases or atmospheres, the system comprising:

an inlet configured to intake raw gas;

an outlet configured to discharge clean gas; and at least one assembly including an ionization section and a downstream collection section including collector stages which are each connected downstream of an ionization stage of the ionization section, the ionization section including at least one level at a right angle to a channel axis, wherein the at least one assembly includes at least two substantially identical ionization stages disposed in one plane and arranged uniformly around the channel axis so that a gas flows radially, with respect to the channel axis, outward therethrough so that a radial gas stream from the associated ionization stage enters and is diverted to a direction parallel to the channel axis.

13. The waste-gas cleaning system as recited in claim 12, further comprising an outlet channel connected with the outlet, wherein the clean gas is discharged into the outlet channel.

14. The waste-gas cleaning system as recited in claim 12, wherein at least two assemblies are arranged in series along the channel axis, the downstream central collection sections being arranged in direct succession and constituting an initial portion of a channel that conveys the gas; and a first downstream central collection section in the direction of gas flow allows the gas streams entering it to only pass on to and through a next downstream central collection section, so that an additive gas stream emerges front a last collection section in the direction of gas flow.

15. The waste-gas cleaning system as recited in claim 14, wherein the at least two assemblies are arranged one after the other in a same configuration with respect to the channel axis.

16. The waste-gas cleaning system as recited in claim 14, wherein the at least two assemblies are arranged angularly offset from each other with respect to the channel axis.

17. The waste-gas cleaning system as recited in claim 12, wherein at least two assemblies are arranged in series along the channel axis, the at least two assemblies each including an ionization section and a downstream collection section, each assembly having the same number of ionization stages, the gas flow in the ionization stages of successive assemblies being in radially opposite directions, and wherein the inlet includes a raw gas channel having a shell with a closed end section having openings so that the raw gas fans out through the openings in the shell of the raw gas channel toward the connected ionization section of a first flow-receiving assembly so as to form substreams which flow to a respective ionization stage, whereby the respective substreams flow radially outward to respective downstream collection stages connected thereto, from which respective downstream collection stages a channel section leads to an associated ionization stage of a next assembly in which the gas substream flows radially inward, whereby all substreams passing through the next assembly flow into an associated downstream central collection section so that the substreams change direction and flow together in an axial direction to be discharged or passed on for further processing.

18. The waste-gas cleaning system as recited in claim 12, wherein at least two assemblies are arranged in series along the channel axis, the at least two assemblies each including an ionization section and a downstream collection section, each assembly having the same number of ionization stages, the gas flow in the ionization stages of successive assemblies being in radially opposite directions, and the inlet includes a raw gas channel that merges fanwise into channels, the channels each opening into one ionization stage of the next respective assembly so that a gas stream made of respective gas substreams in the channels flow radially inward to the downstream central collection section, so that the gas substreams flow into an axially downstream channel section having a shell with a closed end section having openings, so that the gas stream again fans out through the openings in the shell into connected ionization stages of a next assembly so as to flow in said ionization stages radially outward to respective downstream collection stages to be discharged individually, together or to be further processed.

19. The waste-gas cleaning system as recited in claim 12, further comprising a first hollow-cylindrical ionization member having a wall which intersects at least one plane perpendicular to the channel axis, in which at least one perpendicular plane ionization stages which extend through the hollow cylinder wall are uniformly distributed around a circumference, and a second hollow-cylindrical member surrounding the ionization stages at least over a length of the first hollow-cylindrical ionization member, wherein the inlet includes a raw gas channel opening into an end of the first hollow-cylindrical ionization member which is closed at the opposite end so that the raw gas flows radially outward through the ionization stages and the surrounding second hollow-cylindrical member is connected at a raw-gas end with the first hollow-cylindrical ionization member by an annular disk in a gas-tight manner to form a downstream collector for the gas flowing in from the ionization stages, the gas stream being recombined in the downstream collector and discharged therefrom as a clean gas stream at the open end remote from the raw gas side.

20. The waste-gas cleaning system as recited in claim 12, further comprising a first hollow-cylindrical ionization member having a wall which intersects at least one plane perpendicular to the channel axis and a second hollow-cylindrical member surrounding the ionization stages at least over a length of the first hollow-cylindrical member, wherein a raw gas channel is flange-mounted to the end of the second hollow cylindrical member, the second hollow cylindrical member being connected with the first hollow cylindrical ionization member by a gas-tight annular disk at the end remote from the raw gas stream, the first hollow-cylindrical ionization member being closed at the end facing the raw gas stream.

21. The waste-gas cleaning system as recited in claim 20, wherein the gas channel is convex round or convex polygonal in cross section as seen from outside.

22. The waste-gas cleaning system as recited in claim 12, further comprising a first hollow-cylindrical ionization member having a wall which intersects at least one plane perpendicular to the channel axis and a second hollow-cylindrical member surrounding the ionization stages at least over a length of the first hollow-cylindrical member, wherein the inlet includes a raw gas channel flange-mounted to a shell of the second hollow cylindrical member and, together with the first hollow cylindrical ionization member, forms an annular hollow space which is closed at an end in a gas-tight manner, so that, when the raw gas enters at an end and through the shell, the entire raw gas stream flows radially inward through the ionization stages into the interior of the first hollow cylindrical ionization member, where the gas changes direction and flows from the first hollow cylindrical ionization member and through the downstream central collection section, the inside cross section of the first hollow cylindrical member being closed in a gas-tight manner at an end remote from where the gas flows.

23. The waste-gas cleaning system as recited in claim 22, wherein the gas channel is convex round or convex polygonal in cross section as seen from outside.

* * * * *